United States Patent [19]

Iida et al.

[11] 4,235,218

[45] Nov. 25, 1980

[54] TRUING AND DRESSING APPARATUS FOR GRINDING WHEELS

[75] Inventors: Wataru Iida, Aichi; Toshio Tsujiuchi, Anjo, both of Japan

[73] Assignee: Toyoda-Koki Kabushiki-Kaisha, Kariya, Japan

[21] Appl. No.: 8,172

[22] Filed: Jan. 31, 1979

[30] Foreign Application Priority Data

Feb. 20, 1978 [JP] Japan ..... 53/18215

[51] Int. Cl.[3] ..... B24B 53/14

[52] U.S. Cl. ..... 125/11 CD

[58] Field of Search ..... 125/11 R, 11 CD, 11 DF, 125/11 F

[56] References Cited

U.S. PATENT DOCUMENTS

| | | | |
|---|---|---|---|
| 3,971,358 | 7/1976 | Sawluk | 125/11 CD |
| 4,051,830 | 10/1977 | Gruber | 125/11 R |
| 4,073,281 | 2/1978 | Asaeda | 125/11 CD |
| 4,151,684 | 5/1979 | Wada | 125/11 CD |

*Primary Examiner*—Harold D. Whitehead

*Attorney, Agent, or Firm*—Oblon, Fisher, Spivak, McClelland & Maier

[57] ABSTRACT

An apparatus for truing and dressing a grinding wheel made of cubic boron nitride is provided. A support head supporting a truing wheel and another support head supporting a dressing roll are separately and independently arranged on a wheel support of a grinding machine. The truing wheel is rotated in the same direction as is the grinding wheel so as to true the grinding wheel in an up-cut manner, and the dressing roll is rotated in a direction opposite to that of the grinding wheel so as to dress the grinding wheel in a down-cut manner. The dressing roll is fed toward the grinding wheel to be ground thereby and then returned a predetermined amount away from the grinding wheel prior to a truing operation.

5 Claims, 10 Drawing Figures

TRUING AND DRESSING APPARATUS FOR GRINDING WHEELS

BACKGROUND OF THE INVENTION

1. Field of the Invention:

The present invention relates to an apparatus for truing and dressing a grinding wheel made of hard abrasive material, such as cubic boron nitride.

2. Description of the Prior Art:

In a prior truing and dressing apparatus for CBN grinding wheels, such as disclosed in U.S. Pat. No. 4,073,281, the truing and dressing rolls are coaxially mounted in one embodiment, so that independent adjustment thereof relative to the grinding wheel is impossible. In another embodiment, the truing and dressing rolls are mounted on a common carriage, with the dressing roll being adjustable relative to the truing roll. However there the dressing roll cannot be ground by the grinding wheel, since the dressing roll is arranged on the same vertical plane as the truing roll.

SUMMARY OF THE INVENTION

It is therefore an object of the present invention to provide a new and improved truing and dressing apparatus for CBN grinding wheels wherein a support head supporting a truing wheel and a support head supporting a dressing roll are separately and independently arranged on a wheel support of a grinding machine.

Another object of the present invention is to provide a new and improved truing and dressing apparatus of the character set forth above, wherein the dressing roll is fed toward the grinding wheel to be ground thereby prior to a truing operation.

Another object of the present invention is to provide a new and improved truing and dressing apparatus of the character set forth above, wherein the truing wheel is rotated in the same direction as is the grinding wheel so as to true the grinding wheel in an up-cut manner, and the dressing roll is rotated in a direction opposite to that of the grinding wheel so as to dress the grinding wheel in a down-cut manner.

A further object of the present invention is to provide a new and improved truing and dressing apparatus of the character set forth above, wherein the dressing roll is returned a predetermined amount away from the grinding wheel for a dressing operation, after being ground by the grinding wheel.

BRIEF DESCRIPTION OF THE DRAWINGS

The foregoing and other objects and many of the attendant advantages of the present invention will be readily appreciated as the same becomes better understood by reference to the following detailed description, when considered in connection with the accompanying drawings, in which.

DETAILED DESCRIPTION OF THE PREFERRED EMBODIMENT

Figure 1:
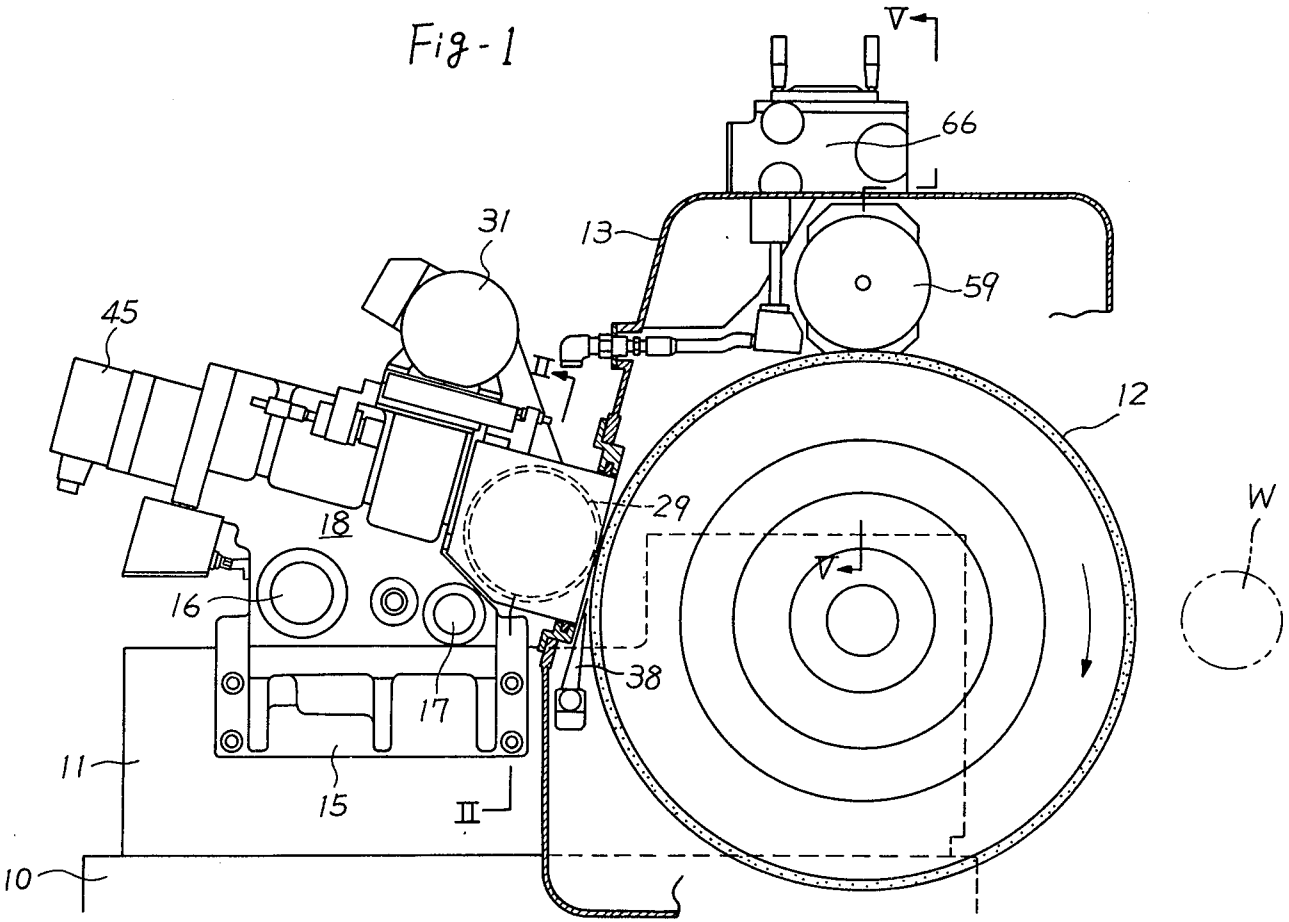
FIG. 1 is an overall view of a truing and dressing apparatus according to the present invention.

Referring now to the drawings, wherein like reference numerals or characters refer to identical or corresponding parts throughout the several views, and more particularly to FIG. 1, there is shown a bed 10 of a grinding machine, on which a wheel support 11 is mounted to be movable toward and away from a workpiece W to be ground. A grinding wheel 12 is mounted on the wheel support 11 to be rotatable about an axis perpendicular to the movement of the wheel support 11. The grinding wheel 12 is of such configuration that abrasive grain, made of a hard material, such as cubic boron nitride, is press-formed and stiffened on the outer peripheral surface of a metallic base ring. This grinding wheel 12 is rotated in the direction of the arrow by a wheel drive motor, not shown, mounted on the wheel support 11. Numeral 13 denotes a wheel cover for the grinding wheel 12.

Figure 4:
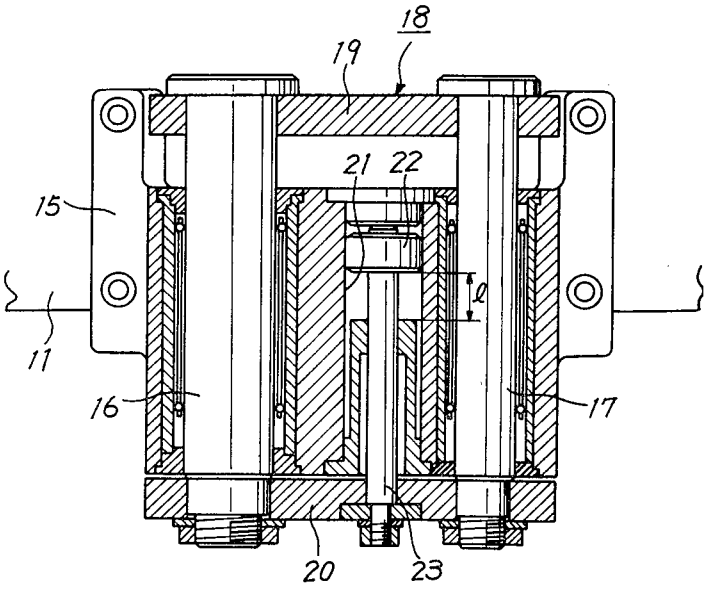
FIG. 4 is a sectional view taken along the line IV—IV in FIG. 3.
Figure 2:
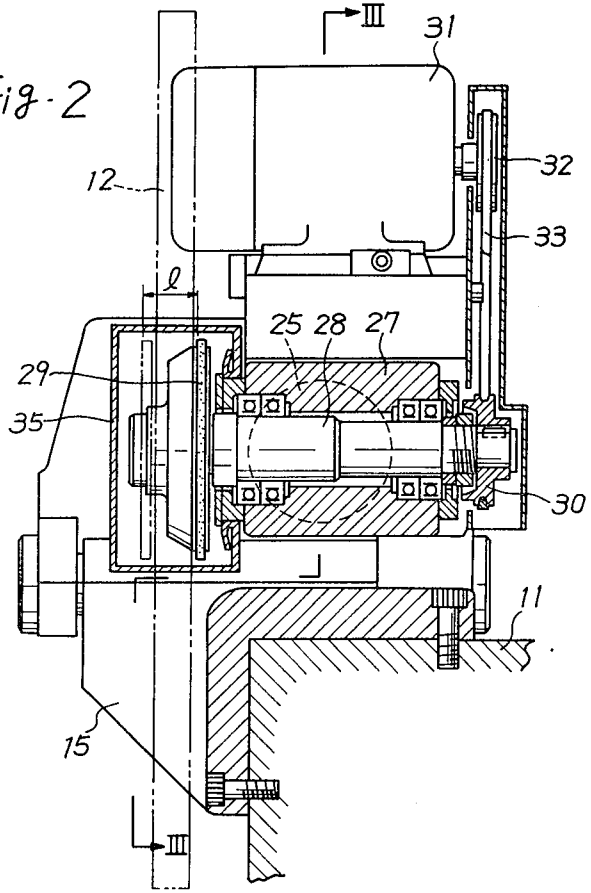
FIG. 2 is an enlarged sectional view taken along the line II—II in FIG. 1.
Figure 3:
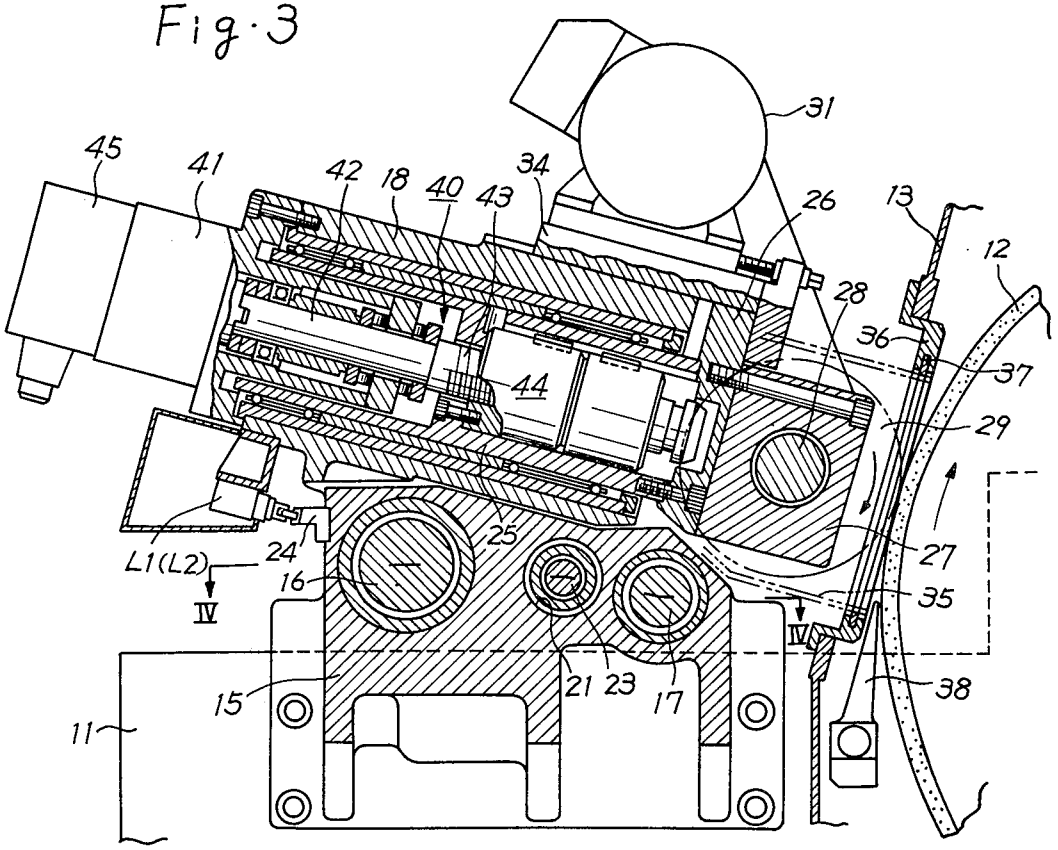
FIG. 3 is a sectional view taken along the line III—III in FIG. 2.

Referring to FIGS. 2, 3 and 4, a support base 15 is mounted on the wheel support 11 rearwardly of the grinding wheel 12. A pair of parallel pilot bars 16 and 17 are received within the support base 15 to be slidable in a horizontal direction parallel to the grinding surface of the grinding wheel 12. End legs 19 and 20 of a traverse carriage 18 are securedly supported on opposite ends of the pilot bars 16 and 17 projected from the support base 15. The support base 15 is formed with a traverse cylinder 21 within which a piston 22 is received to be slidable in a direction parallel to the axes of the pilot bars 16 and 17. A piston rod 23 of the piston 22 is secured to the leg 20 of the traverse carriage 18, so that the traverse carriage 18 is traversed a predetermined stroke L by the actuation of the traverse cylinder 21. The traverse carriage 18 is detected by limit switches L1 and L2 actuated by a dog 24 fixed to the support base 15.

An in-feed ram 25 is received in the traverse carriage 18 to be slidable in a direction inclined downwardly toward the center of the grinding wheel 12. The ram 25 has fixed at its one end a plate 26 to which is connected a pilot bar, not shown, slidably received in the traverse carriage 18 for movement in a direction parallel to the axis of the ram 25 to prevent rotation of the ram 25. A support head 27 is secured to the plate 26 and rotatably carries a support shaft 28 for rotation about an axis parallel to the grinding surface of the grinding wheel 12. A truing wheel 29 is secured to one end of the support shaft 28 and enters within the wheel cover 13 through the opening formed at the rear portion of the wheel cover 13. The truing wheel 29 is such that an abrasive grain of diamond is stiffened on the outer periphery of a metal-made base ring and is designed to have its width less than that of the grinding wheel 12 in order to decrease resistance occurring in the truing operation. The support shaft 28 has secured to its other end a pulley 30 which is connected through belts 33 to a pulley 32 secured to an output shaft of a drive motor 31. The motor 31 is mounted on a motor base 34 which is slidably and adjustably mounted on the traverse carriage 18 for movement in a direction parallel to the axis of the in-feed ram 25. The motor base 34 is also connected to the plate 26 for adjustment of its position. The truing wheel 29 is rotated by the motor 31 in the same direction as is the grinding wheel 12 to perform a up-cut truing operation on the grinding wheel 12.

A cover 35, formed in rectangular shape in cross-section, is secured to the support head 27 to cover the truing wheel 29. A guide frame 36 is fitted into the rear opening of the wheel cover 13 and slidably receives a slide plate 37 for movement in the traversing direction of the traverse carriage 18. The slide plate 37 is formed with a rectangular opening to receive the cover 35. Numeral 38 denotes a coolant nozzle to supply coolant between the truing wheel 29 and the grinding wheel 12.

An in-feed apparatus 40 is provided for in-feeding the support head 27 secured to the in-feed ram 25 by one unit toward the grinding wheel 12. The in-feed apparatus 40 comprises an in-feed box 41 which is secured to the rear end of the traverse carriage 18 and supports an in-feed shaft 42 to be rotatable about the axis coaxial with that of the in-feed ram 25. The in-feed shaft 42 is formed at its front end with a threaded portion 43 which is in threaded engagement with a nut 44 secured within the in-feed ram 25. The rear end of the in-feed shaft 42 is connected to a pulse motor 45 through a suitable reduction gearing received in the in-feed box 41, whereby the in-feed shaft 42 is rotated by an angle of one unit by the pulse motor 45 to render an in-feed movement of one unit to the support carriage 18 through the in-feed ram 25.

Figure 5:
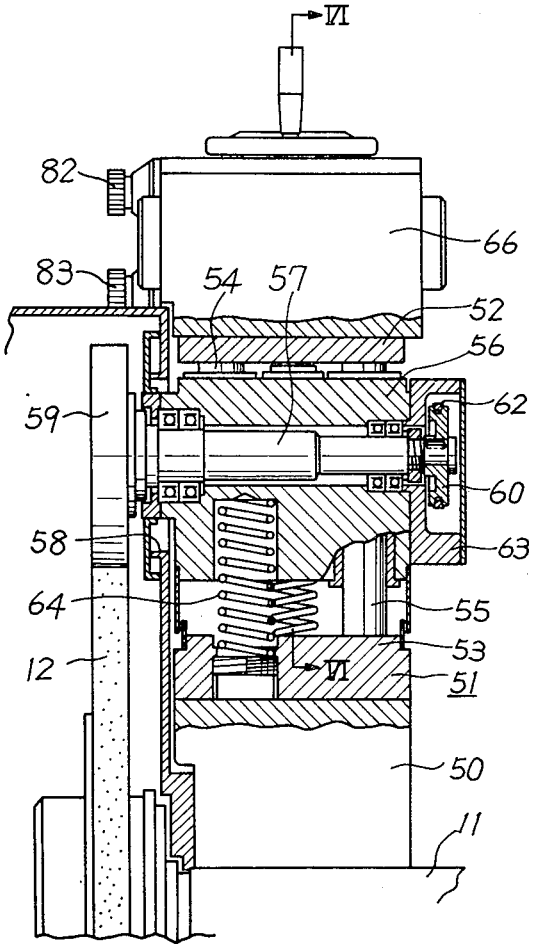
FIG. 5 is an enlarged sectional view taken along the line V—V in FIG. 1.
Figure 6:
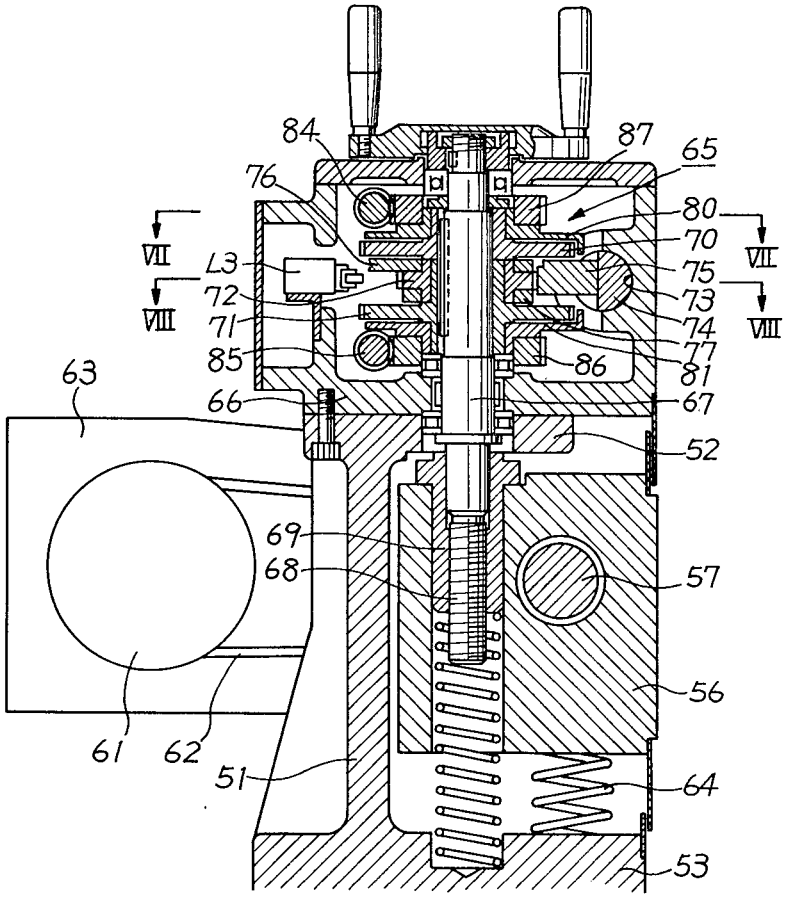
FIG. 6 is an enlarged sectional view taken along the line VI—VI in FIG. 5.

Referring to FIGS. 1, 5 and 6, a pedestal 50 is mounted on the wheel support 11 above the grinding wheel 12. A support base 51 in channel or U-shaped form is mounted on the pedestal 50 and is provided with upper and lower flange portions 52 and 53 to which a pair of parallel pilot bars 54 and 55 are connected. These bars 54 and 55 support a support head 56 to be slidable upward and downward toward and away from the center of the grinding wheel 12. A support shaft 57 is rotatably supported in the support head 56 in parallel relationship with the grinding surface of the grinding wheel 12 and enters at its front end into the wheel cover 13 through a window 58 formed on the wheel cover 13. A dressing roll 59 is secured to the front end of the support shaft 57 in opposed relationship with the grinding wheel 12. The dressing roll 59 is made of a refined steel, hardened steel or other material which has the same hardness, toughness and resistance to wear as the refined or hardened steel does, and is designed to have substantially the same width as the grinding wheel 12. The support shaft 57 has secured at its rear end a pulley 60 which is connected through a belt 62 to a pulley, not shown, secured to an output shaft of a drive motor 61. The motor 61 is mounted on a plate 63 secured to the rear side surface of the support head 56. The dressing roll 59 is rotated by the motor 61 in a direction opposite to that of the grinding wheel 12 for a dressing operation in a down-cut manner. Numeral 64 denotes a spring interposed between the support head 56 and the lower flange portion 53 of the support base 51 for bearing the weight of the support head 56.

Figure 8:
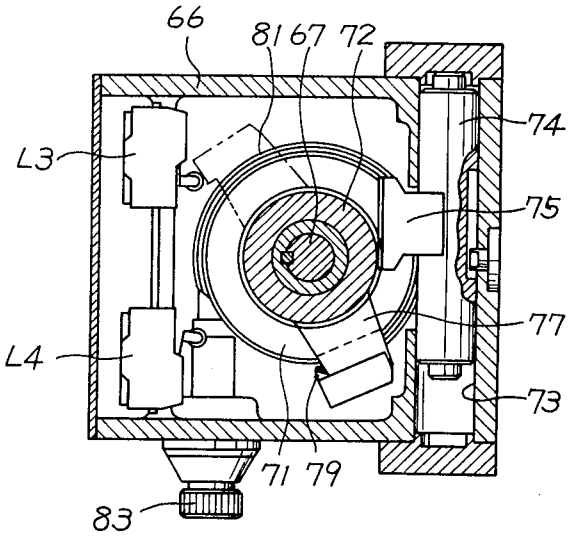
FIGS. 7 and 8 are sectional views taken along the lines VII—VII and VIII—VIII in FIG. 6, respectively.
Figure 7:
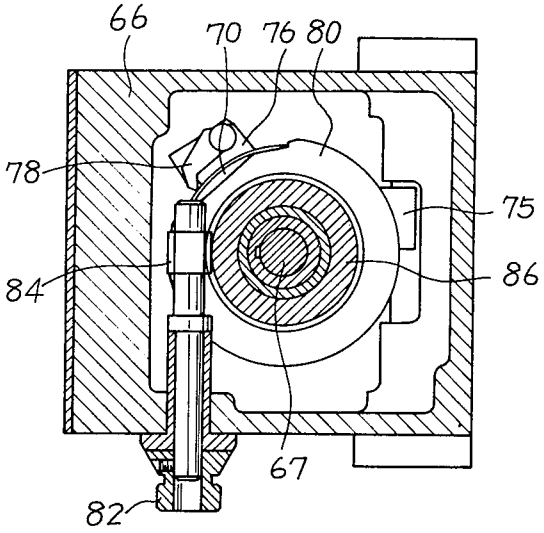

Referring to FIGS. 6, 7 and 8, a feed apparatus 65 is provided for moving the support head 56 toward and away from the grinding wheel 12. The feed apparatus 65 comprises a feed box 66 which is secured on the upper flange portion 52 of the support base 51 and rotatably supports a feed shaft 67 in the direction of sliding movement of the support head 56. The feed shaft 67 is formed at its one end with a threaded portion 68 which is in threaded engagement with a feed nut 69 secured at the top surface of the support head 56. Keyed to the feed shaft 67 are two ratchet wheels 70 and 71, between which a pinion 72 is mounted rotatably relative to the ratchet wheels 70 and 71. The feed box 66 is formed with a feed cylinder 73 in a direction perpendicular to the feed shaft 67. A piston 74 is received in the feed cylinder 73 so as to be slidable back and forth a predetermined stroke and has secured thereto a rack 75 in meshing engagement with the pinion 72. Accordingly, the pinion 72 is rotated within a predetermined angular range in opposite directions by the operation of the feed cylinder 73. A pair of radially extending ratchet holders 76 and 77 are secured on opposite sides of the pinion 72 and have pivoted thereto a pair of ratchets 78 and 79 engageable with the ratchet wheels 70 and 71, respectively. The ratchets 78 and 79 are urged toward the ratchet wheels 70 and 71 by springs, not shown. The ratchets 78 and 79 are arranged in such a manner as to rotate the ratchet wheels 70 and 71 in opposite directions. More specifically, when the ratchet holders 76 and 77 are rotated in a normal direction, namely in a clockwise direction as viewed in FIG. 8, the ratchet wheel 71 is moved by the ratchet 79 to rotate the feed shaft 67 in the normal direction. On the other hand, when the ratchet holders 76 and 77 are rotated in the reverse direction, the ratchet wheel 70 is moved by the ratchet 78 to rotate the feed shaft 67 in the reverse direction. In order to make the reverse rotary amount of the feed shaft 67 smaller than the normal rotary amount, baffle plates 80 and 81 are provided adjacent the ratchet wheels 70 and 71 to set positions where the ratchets 78 and 79 are first engaged with the ratchet wheels 70 and 71. Angular positions of the baffle plates 80 and 81 are adjustable by manipulating adjustment knobs 82 and 83 secured to the outer surface of the feed box 66 and connected to the baffle plates 80 and 81 through worms 84, 85 and worm wheels 86, 87, respectively. Numerals L3 and L4 denote limit switches for detecting the rotation ends of the ratchet holders 76 and 77.

Figure 9:
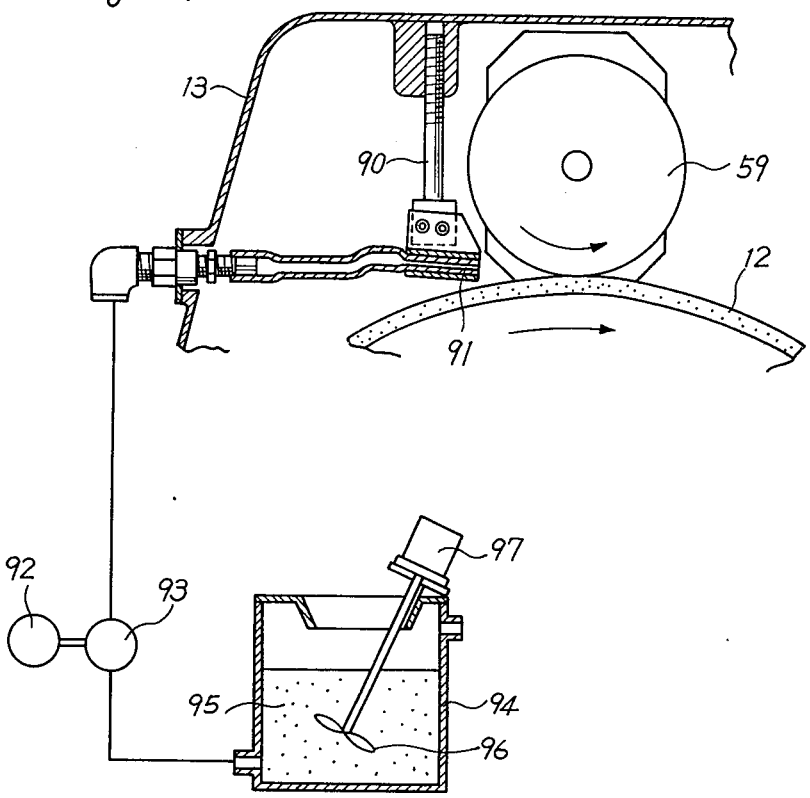
FIG. 9 is an enlarged view, partly in section, of a portion shown in FIG. 1.

Referring to FIG. 9, within the wheel cover 13, a dressing fluid supply nozzle 91 is supported by a supporting rod 90 so as to be horizontal toward the dressing point between the dressing roll 59 and the grinding wheel 12. The supporting rod 90 is adjustably supported by the wheel cover 13. The supply nozzle 91 is connected to a reservoir 94 containing the coolant fluid through a pump 93 driven by a motor 92. The coolant fluid is mixed with free abrasive grain 95, such as aluminum oxide, silicon carbide or the like. In order to prevent the free abrasive grain 95 from separating from the grinding fluid, there is provided a mixing fan 96, which is driven by a motor 97.

The operation of the truing and dressing apparatus according to the present invention will now be described.

When the cutting ability of the grinding wheel 12 has deteriorated as a result of repeated grinding operations, a truing-dressing start command is generated. In response to this command, the motor 61 is energized to rotate the dressing roll 59 in a direction opposite to that of the grinding wheel 12. Subsequently, pressurized fluid is supplied into the upper chamber of the feed cylinder 73 (FIG. 8) to move the piston 74 downwardly to thereby rotate the ratchet holders 76 and 77 in the normal direction through the rack 75 and the pinion 72.

With the piston 72 reaching the end of its downward stroke, this is confirmed by the limit switch L4 actuated by the ratchet holder 77.

Figure 10:
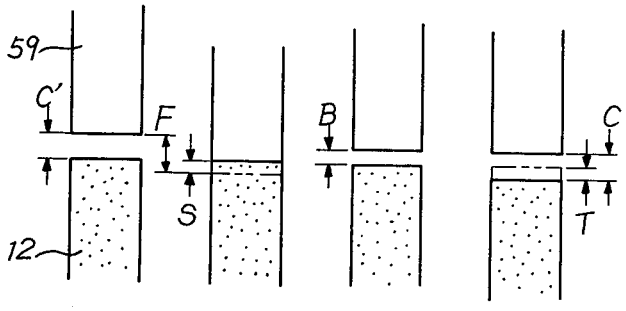
FIG. 10 shows a positional relationship between the dressing roll and the grinding wheel.

The feed shaft 67 is rotated a predetermined amount in the normal direction by the normal rotation of the ratchet holders 76 and 77 through the ratchet 79 and the ratchet wheel 71, so that the dressing roll 59 and the support head 56 are moved an amount F toward the grinding wheel 12 through a thread mechanism. Accordingly, as shown in FIG. 10, the dressing roll 59 is ground a small amount S by the grinding wheel 12 to set a space therebetween to be zero. Then, the supply of pressurized fluid into the feed cylinder 73 is changed to rotate the ratchet holders 76 and 77 in the reverse direction through the rack and pinion mechanism to rotate the feed shaft 67 in the reverse direction through the ratchet 78 and the ratchet wheel 70. The position, where the ratchet 78 is first engaged with the ratchet wheel 80 by the rotation of the ratchet holder 76, is determined by the baffle plate 80 in such a manner that the reverse rotary movement amount of the feed shaft 67 is smaller than the normal rotary movement amount. Accordingly, the support head 56 and the dressing roll 59 are moved a small amount B away from the grinding wheel 12 to form the clearance B between the grinding wheel 12 and the dressing roll 59. The clearance B plus the decreased diameter of the grinding wheel 12 due to the truing operation described below provides a proper clearance C required for the dressing operation between the grinding wheel 12 and the dressing roll 59.

When the dressing roll 59 is moved the predetermined amount B away from the grinding wheel 12, as described above, and this is confirmed by the limit switch L3 actuated by the ratchet holder 76, the pulse motor 45 is rotated a set amount to rotate the in-feed shaft 42 a unit angle through the reduction mechanism, not shown. This rotation of the in-feed shaft 42 causes the in-feed ram 25 and the support head 27 to move toward the grinding wheel 12 through the thread mechanism to render a predetermined in-feed amount to the truing wheel 29. At the same time therewith, the motor 31 is energized to rotate the truing wheel 29 in the same direction as that of the grinding wheel 12, and coolant is supplied from the coolant nozzle 38.

Subsequently, pressurized fluid is admitted into the upper chamber of the traverse cylinder 21 (FIG. 4) to move the traverse carriage 18, supported by the pilot bars 16 and 17, the predetermined amount l together with the piston 22 and the piston rod 23 so as to permit the truing wheel 29 to true the peripheral grinding surface of the grinding wheel 12 a predetermined amount. Since the rotational direction of the truing wheel 29 is the same as that of the grinding wheel 12, as shown in FIG. 3, the truing operation is performed in an up-cut manner, thereby decreasing the truing resistance and preventing generation of run-out on the grinding wheel 12. Accordingly, swell or run-out produced on the grinding wheel 12 during grinding operations can be positively removed.

In this manner, when the grinding wheel 12 is trued by the truing wheel 29 and the traverse carriage 18 reaches its traverse end, this is confirmed by the limit switch L2 actuated by the dog 24. In response to this confirmation signal from the limit switch L2, supply of pressurized fluid into the traverse cylinder 21 is changed to move the traverse carriage 18 into its original position in the reverse direction. When this is confirmed by the limit switch L1 actuated by the dog 24, the motor 31 is deenergized and the supply of coolant is stopped.

When the truing operation is completed on the grinding wheel 12, a virtually constant clearance C (found by addition of the decreased amount T of the grinding wheel radius by the truing operation, which is substantially equal to the in-feed amount of the truing wheel 29, and the above-mentioned clearance (B) is formed between the grinding wheel 12 and the dressing roll 59.

Subsequently, the motor 61 is again energized to rotate the dressing roll 59 in the direction opposite to that of the grinding wheel 12, and the pump 93 is actuated by the motor 92. A predetermined amount of free abrasive grain 95 is supplied in advance into the reservoir 94 and is mixed with coolant fluid by the mixing fan 96. This dressing fluid is supplied from the supply nozzle 91 toward the clearance C between the grinding wheel 12 and the dressing roll 59 by the operation of the pump 93. The free abrasive grain 95 in the dressing fluid supplied toward the clearance bites and grinds the bond material supporting abrasive grain of the grinding wheel 12 from the wheel surface, backed up with the dressing roll 59, so that the grinding wheel 12 is dressed to protrude the abrasive grain beyond the remaining bond material. Since the rotational direction of the dressing roll 59 is opposite to that of the grinding wheel 12, as shown in FIG. 9, the dressing operation is performed in a down-cut manner so as to decrease the relative rotational speed between the grinding wheel 12 and the dressing roll 59 and to permit easy entering of the free abrasive grain 95 into the clearance therebetween, resulting in an effective dressing operation. This dressing operation continues until a timer, not shown, is timed out after a set time period. With this timer being timed out, the motor 92 is deenergized to stop the supply of the dressing fluid and the motor 61 for rotation of the dressing roll 59 is deenergized. Since the peripheral surface of the dressing roll 59 is also ground by the free abrasive grain 95, the clearance between the dressing roll 59 and the grinding wheel 12 is changed into C'.

In the above-described embodiment, after the dressing roll 59 is ground by the grinding wheel 12, the support head 56 is returned the predetermined distance B to form the predetermined clearance C together with the decreased grinding wheel radius caused by the truing operation. It is to be noted here that the clearance C is determined depending upon the size of the free abrasive grain 95. Therefore, the return of the support head 56 after the grinding on the dressing roll 59 is not always required, but the clearance C may be formed depending upon only the decreased amount of the grinding wheel radius caused by the truing operation.

As described above, according to the present invention, the support head supporting the truing wheel and the support head supporting the dressing roll are independently mounted at the rear and upper positions of the wheel support supporting the CBN grinding wheel, which positions are separated circumferentially of the grinding wheel. These support heads are fed by the in-feed and feed apparatus. Accordingly, the truing and dressing apparatus are held always in constant positions relative to the grinding wheel, whereby the cycle of truing and dressing can be shortened. A slight in-feed amount of the truing wheel relative to the grinding wheel can be accurately and positively rendered, whereby a highly accurate truing can be performed and the life of the grinding wheel can be prolonged. Furthermore, the support heads are independent relative to each other, whereby the clearance between the dressing roll and the grinding wheel, formed by dressing by the free abrasive grain, can be easily changed.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An apparatus for truing and dressing a grinding wheel made of cubic boron nitride and rotatably mounted on a wheel support of a grinding machine, comprising in combination:

a first support base fixedly secured on said wheel support at the rear of said grinding wheel;

a traverse carriage slidably mounted on said first support base so as to be moved in a direction parallel to the axis of said grinding wheel;

a first support head slidably mounted on said traverse carriage so as to be moved toward and away from the grinding surface of said grinding wheel;

a truing wheel provided at an outer peripheral surface thereof with abrasive grain as hard as diamond and rotatably carried on said first support head;

in-feed means for feeding said first support head toward said grinding wheel so as to give an in-feed movement of a predetermined amount to said truing wheel;

a first deive motor for rotating said truing wheel;

traverse feed means for moving said traverse carriage to perform a truing operation by said truing wheel on said grinding wheel;

a second support base fixedly mounted on said wheel support independently of said first base;

a second support head slidably mounted on said second support base so as to be moved toward and away from the grinding surface of said grinding wheel;

a dressing roll made of metal and rotatably supported on said second support head and over said grinding wheel;

feed means for feeding said second support head toward said grinding wheel by a predetermined feed amount so as to cause said dressing roll to be ground by said grinding wheel prior to said truing operation;

a second drive motor for rotating said dressing roll; and means for supplying free abrasive grain between said grinding wheel and said dressing roll to perform a dressing operation on said grinding wheel after said truing operation.

2. An apparatus as claimed in claim 1, wherein said first drive motor rotates said truing wheel in the same direction as that of said grinding wheel so as to true said grinding wheel in an up-cut manner, and said second drive motor rotates said dressing roll in a direction opposite to that of said grinding wheel so as to dress said grinding wheel in a down-cut manner.

3. An apparatus as claimed in claim 1, wherein said feed means also has the function of returning said dressing roll by a predetermined amount away from said grinding wheel for a dressing operation, after said dressing roll is ground by said grinding wheel.

4. An apparatus as claimed im claim 3, wherein said feed means comprises:

a rotatable feed shaft threadedly engaged with said second support head;

a pair of ratchet wheels secured on said feed shaft;

a pinion rotatably mounted on said feed shaft between said ratchet wheels;

a feed cylinder;

a piston slidably received in said feed cylinder to be moved a predetermined distance;

a rack formed on said piston and in meshing engagement with said pinion;

a pair of ratchet holders secured on opposite sides of said pinion; and a pair of ratchets pivoted on said ratchet holders and being engageable with said ratchet wheels to rotate said ratchet wheels in opposite directions.

5. An apparatus as claimed in claim 4, wherein said feed means further comprises:

a pair of baffle plates rotatably mounted on said feed shaft, each for determining a position where each ratchet is first engaged with each ratchet wheel;

a pair of knobs for angularly adjusting said baffle plates; and a pair of worm and worm wheel mechanisms arranged between said baffle plates and said knobs.

* * * * *